US005281039A

United States Patent [19]

Hsiung et al.

[11] Patent Number: 5,281,039

[45] Date of Patent: Jan. 25, 1994

[54] PEN WITH A TOY LABYRINTH INCORPORATED THEREIN

[76] Inventors: Chi Hsiung; Roger Lee, both of 8F-6, No. 100, Sec. 2, Hoping E. Rd., Taipei, Taiwan

[21] Appl. No.: 987,603

[22] Filed: Dec. 9, 1992

[51] Int. Cl.[5] ..... B43K 29/00; A63B 67/14

[52] U.S. Cl. ..... 401/195; 401/52; 273/113

[58] Field of Search ..... 401/195, 52; 273/153 R, 273/109, 113-116; D19/36, 41, 42, 46

[56] References Cited

U.S. PATENT DOCUMENTS 3,135,512 6/1964 Taylor ..... 273/109

4,541,630 9/1985 Dirks ..... 401/195

4,861,036 8/1989 Watanabe ..... 273/109 X

FOREIGN PATENT DOCUMENTS 1608089 11/1990 U.S.S.R. ..... 401/52

2197826 6/1988 United Kingdom ..... 401/195

*Primary Examiner*—Danton D. DeMille

*Attorney, Agent, or Firm*—Browdy and Neimark

[57] ABSTRACT

A pen having a barrel with a transparent sleeve to hold a refill for writing, wherein an intricate network of winding passage ways is formed around the barrel, where by tilting and turning the ball finds its way starting from its designated point.

1 Claim, 5 Drawing Sheets

FIG. 4
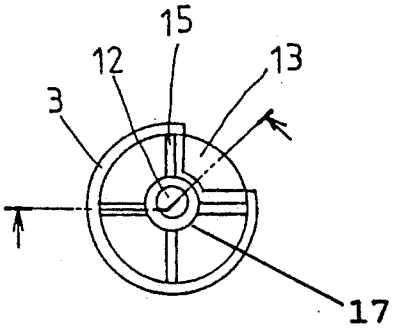
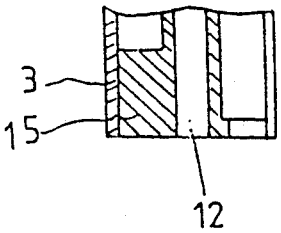
FIG. 5

PEN WITH A TOY LABYRINTH INCORPORATED THEREIN

BACKGROUND OF THE INVENTION

The present invention relates to a pen which can be used as a tool for writing as well as a toy for playing the game of labyrinth.

Different writing apparatus may be used for different purposes. However, a pen is simply designed for writing and does not provide any other functions. Recently, there are manufactures who combine a pen with a digital watch, clipper, lighter or other small devices for multiple purposes. Since writing is a tiresome activity one has to take a rest from it. Thus, you can now convert it as toy for fun and relaxation.

SUMMARY OF THE INVENTION

The present invention has been accomplished under the aforesaid circumstances. It is therefore the main objective of the present invention to provide a pen with a toy labyrinth incorporated therein which can be alternatively used as a tool for writing, and or as a toy for playing the game of labyrinth. According to the preferred embodiment of the present invention, the body of the pen is in the form of a barrel with a transparent sleeve enclosing it. The barrel has a series of chambers around a peripheral wall thereof defined by a series of circular, horizontal flanges disposed in parallel at different elevations. The chambers are respectively divided into a plurality of small cells by division walls. Openings are made on the circular, horizontal flanges at different locations for permitting the chambers to be communicated with one another. Therefore, the small cells and the openings form into an intricate network of winding passage ways for the ball to move on when turning the pen.

BRIEF DESCRIPTION OF THE DRAWINGS

FIG. 4 is a bottom view of the barrel;

FIG. 5 is part of the side view section of the barrel; and

DETAILED DESCRIPTION OF THE PREFERRED EMBODIMENT

Figure 1:
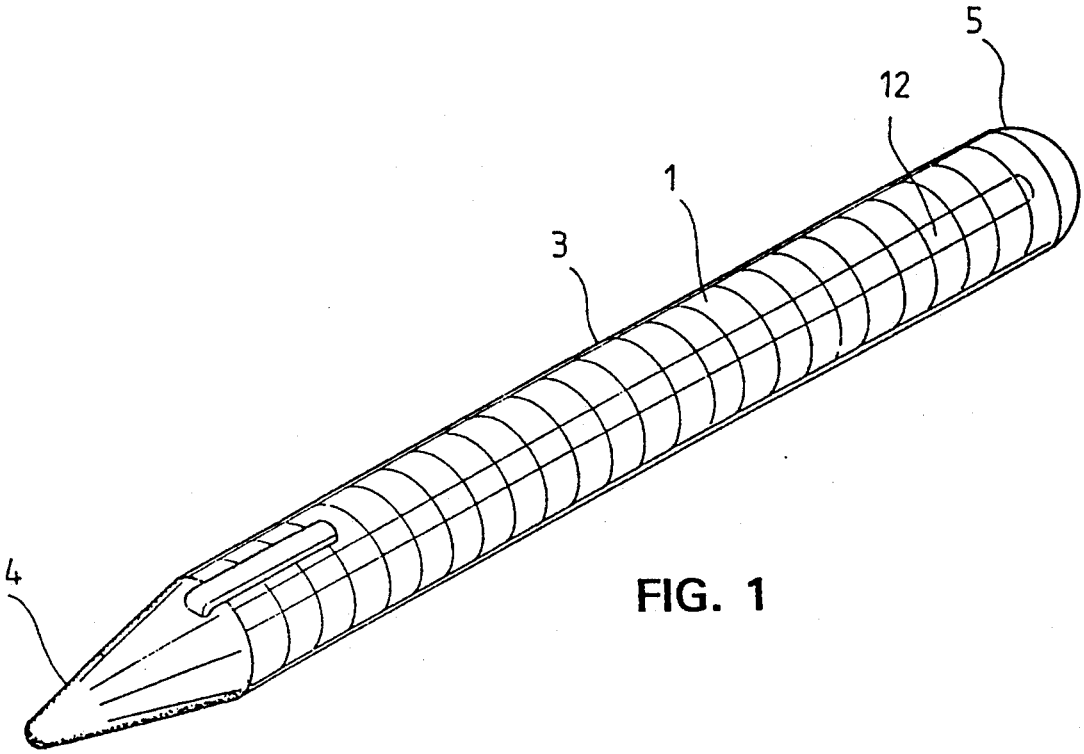
FIG. 1 is a perspective elevational view of a pen embodying the present invention.
Figure 2:
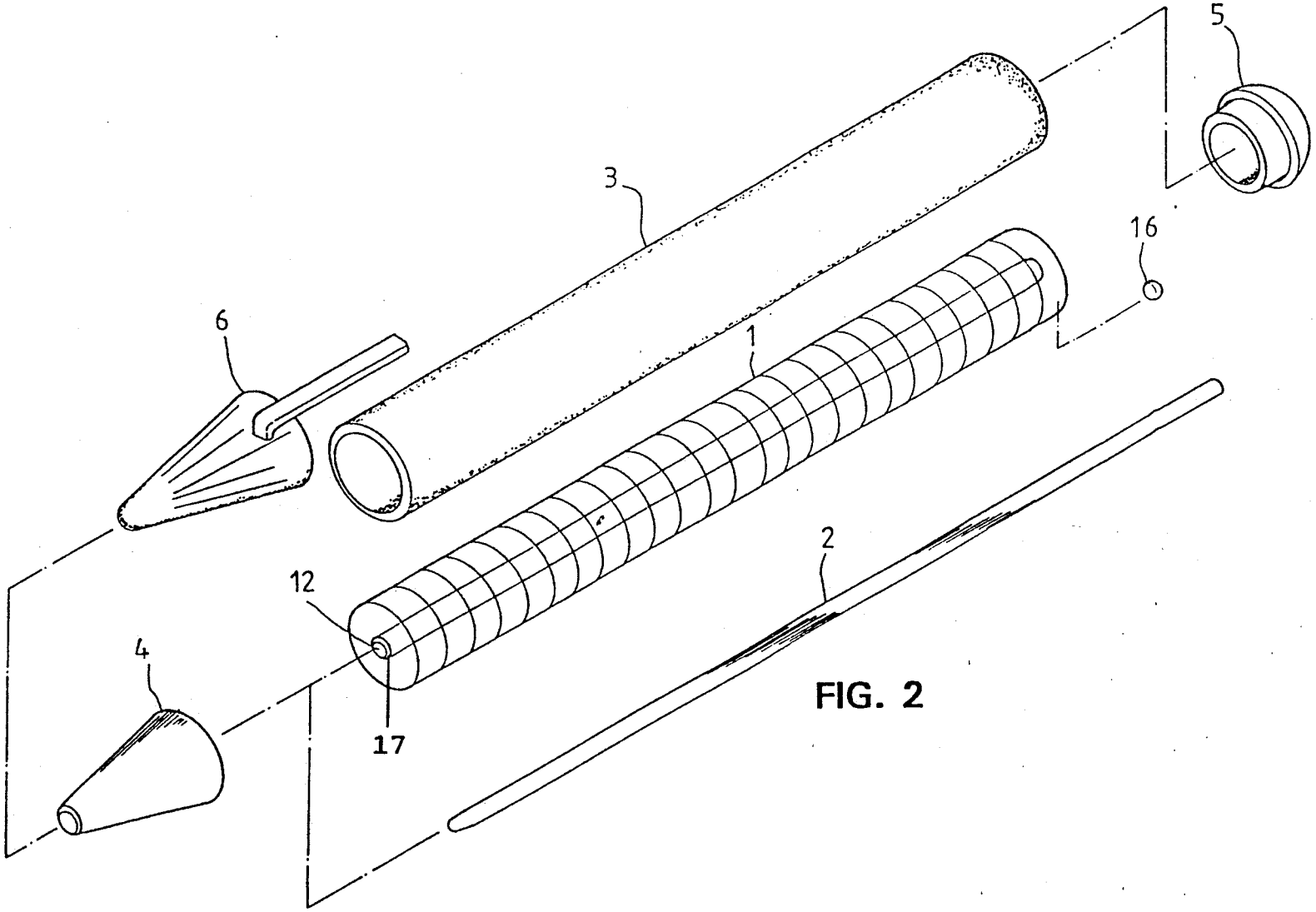
FIG. 2 is a perspective view of the different parts of the pen thereof.
Figure 3:
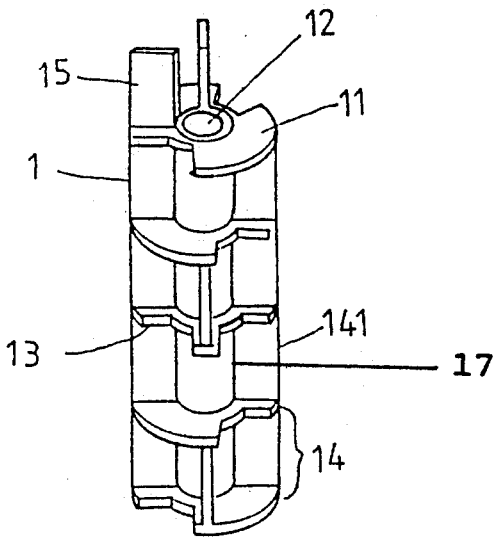
FIG. 3 is the upper part view of the barrel of the pen.

Referring to FIGS. 1 through 5, the pen as illustrated is constructed in accordance with the present invention which is generally comprised of a barrel 1, a refill 2, a transparent sleeve 3, a bottom socket 4, a top cap 5,and a bottom cap 6.

The barrel 1 has a center hole 12 along the longitudinal axis of internal cylinder 17 thereof, and a series of chambers 14 around the periphery of interal cylinder 17 defined by a series of circular, horizontal flanges 11 disposed in parallel at different elevations. Each chamber 14 is further divided into a number of small cells 141 by division walls 15. Openings 13 are made on the circular, horizontal flanges 11 at different locations for permitting the chambers 14 to be communicated with one another. By turning the pen, the metal ball 16 can move from one cell to another. The refill 2 is inserted into the center hole 12 on the barrel 1 with the tip extended out of the barrel 1 for writing. The transparent sleeve 3 enclosing the barrel 1 is for comfortable and positive grip. The bottom socket 4 is a tapered socket mounted on the barrel 1 and fastened to the transparent sleeve 3 at one end. The top cap 5 is inserted on the transparent sleeve 3 at an opposite end to seal the barrel 1 inside the transparent sleeve 3. The bottom cap 6 is a removable cover of the bottom socket 4, with an extended unit serving as a clip of the pen on a pocket.

Figure 6:
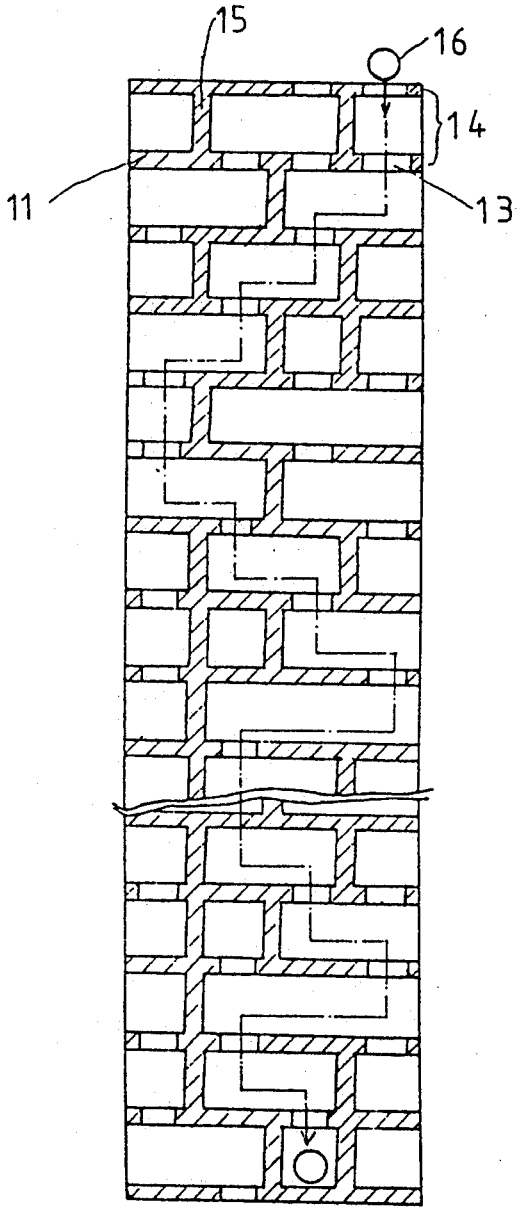
FIG. 6 is a plan view in vertical position showing the small cells of the chambers and the openings on the circular, horizontal flanges of the barrel formed into an intricate network of winding passages for rolling the ball.

Referring to FIG. 6, the cells 141 of the chambers 14 and the openings 13 on the circular, horizontal flanges 11 form into an intricate network of winding passages for the ball 16 to move from the top cell, which is designated as the starting point, to the bottom cell, which is the finishing point and vise versa. As the openings 13 are made on the circular, horizontal flanges 11 at different locations, a cell may be disposed in communication with another cell above or another cell below, or with both of them. This arrangement makes the network of winding passage ways more tricky for playing.

As indicated, the present invention is to provide a pen which can be both used for writing and as a toy through the mind stimulating, full-filled exciting game of labyrinth.

What is claimed is:

1. A pen comprising:

a barrel having a coaxial internal cylinder to hold a refill for writing, said barrel having a series of chambers around a peripheral wall of said internal cylinder, said chambers defined by a series of circular flanges spaced in parallel and engaged along the length of said internal cylinder, each chamber of said chambers being divided into a number of small cells by division walls, at least one opening at a different location on each circular flange of said circular flanges for allowing said each chamber to communicate with adjacent chambers of said chambers, said small cells and each said at least one opening forming an intricate network of winding passages, a transparent sleeve engaged around an outer periphery of said circular flanges and a ball movably contained between said transparent sleeve and said internal cylinder to permit passage through said each said at least one opening from one cell of said small cells designated as a starting point to a last cell of said small cells as finishing point.

* * * * *